US009097090B2

(12) United States Patent
Davey et al.

(10) Patent No.: US 9,097,090 B2
(45) Date of Patent: Aug. 4, 2015

(54) COMMUNICATIONS CONNECTION IN A SUBSEA WELL

(75) Inventors: Peter John Davey, North Somerset (GB); Ian Kent, Bristol (GB)

(73) Assignee: GE Oil & Gas UK Limited, Aberdeen (GB)

( * ) Notice: Subject to any disclaimer, the term of this patent is extended or adjusted under 35 U.S.C. 154(b) by 1234 days.

(21) Appl. No.: 13/009,512

(22) Filed: Jan. 19, 2011

(65) Prior Publication Data

US 2011/0181436 A1 Jul. 28, 2011

(30) Foreign Application Priority Data

Jan. 21, 2010 (GB) ..... 1000964.5

(51) Int. Cl.
*G01V 3/00* (2006.01)
*E21B 33/038* (2006.01)
*E21B 47/12* (2012.01)

(52) U.S. Cl.
CPC ..... *E21B 33/0385* (2013.01); *E21B 47/123* (2013.01)

(58) Field of Classification Search
CPC ..... G10V 3/00
USPC ..... 340/853.1, 854.3, 854.6, 854.7; 398/115–117, 135–139
See application file for complete search history.

(56) References Cited

U.S. PATENT DOCUMENTS

| | | | | |
|---|---|---|---|---|
| 4,598,290 | A | 7/1986 | Collins et al. | |
| 4,721,355 | A | 1/1988 | Gould | |
| 5,888,101 | A * | 3/1999 | Dent et al. | 439/680 |
| 7,044,656 | B1 * | 5/2006 | Hofmeister et al. | 385/89 |
| 7,331,819 | B2 * | 2/2008 | Nelson et al. | 439/577 |
| 7,665,906 | B2 * | 2/2010 | Tamanuki et al. | 385/92 |
| 8,075,199 | B2 * | 12/2011 | Losio et al. | 385/92 |
| 8,224,182 | B2 * | 7/2012 | Kondo | 398/15 |
| 2004/0197104 | A1 * | 10/2004 | Doo et al. | 398/164 |
| 2006/0269196 | A1 * | 11/2006 | Tamanuki et al. | 385/92 |
| 2006/0286867 | A1 * | 12/2006 | LeGrow et al. | 439/620.24 |
| 2008/0085619 | A1 * | 4/2008 | Cadoret et al. | 439/153 |
| 2008/0299826 | A1 | 12/2008 | Cheng et al. | |
| 2009/0033331 | A1 * | 2/2009 | Stoesz | 324/323 |
| 2009/0060425 | A1 * | 3/2009 | Aronson | 385/88 |
| 2009/0092360 | A1 | 4/2009 | Lin et al. | |
| 2009/0297159 | A1 | 12/2009 | Margolin et al. | |
| 2010/0202463 | A1 * | 8/2010 | Robinson | 370/400 |
| 2010/0215376 | A1 * | 8/2010 | Nyffenegger et al. | 398/116 |
| 2010/0246142 | A1 * | 9/2010 | Phillips et al. | 361/747 |
| 2010/0281518 | A1 * | 11/2010 | Bugenhagen | 726/3 |

(Continued)

FOREIGN PATENT DOCUMENTS

| | | | |
|---|---|---|---|
| CN | 1516933 | A | 7/2004 |
| CN | 1997808 | A | 7/2007 |
| CN | 101138176 | A | 3/2008 |

(Continued)

OTHER PUBLICATIONS

Search Report, Dated Apr. 8, 2010.

(Continued)

*Primary Examiner* — Amine Benlagsir

(74) *Attorney, Agent, or Firm* — GE Global Patent Operation

(57) ABSTRACT

A communication connection in a subsea well for converting an optical signal from an optical fiber to an electrical signal, comprising a small form factor pluggable device.

15 Claims, 3 Drawing Sheets

(56) References Cited

U.S. PATENT DOCUMENTS

| | | | | |
|---|---|---|---|---|
| 2010/0303465 | A1* | 12/2010 | Dahlfort | 398/115 |
| 2011/0058777 | A1* | 3/2011 | Gazzola et al. | 385/92 |

FOREIGN PATENT DOCUMENTS

| | | | |
|---|---|---|---|
| CN | 101317114 | A | 12/2008 |
| GB | 2214004 | A | 8/1989 |
| WO | 92/20948 | A1 | 11/1992 |
| WO | WO 2008020152 | A1 * | 2/2008 |
| WO | WO 2009070062 | A1 * | 6/2009 |

OTHER PUBLICATIONS

Wang, Jianming-Zhou Wenbin, "Application of SDH Optical Transmission System in Offshore Oil," Science and Technology Information, Jan. 5, 2007, pp. 8-11.

CN Office Action dated Dec. 30, 2013 from corresponding Application No. 201110033645.1.

Unofficial English Translation of Chinese Office Action and Search Report issued in connection with CN Application No. 201110033645.1 on Oct. 29, 2014.

* cited by examiner

COMMUNICATIONS CONNECTION IN A SUBSEA WELL

BACKGROUND OF THE INVENTION

1. Field of the Invention

The present invention relates to a communications connection in a subsea well.

2. Description of Related Art

Subsea wells, such as hydrocarbon extraction wells, are typically supplied with hydraulic and electrical power and communications via an umbilical from a surface platform or surface vessel. Modern wells use optical fibers for communication to the umbilical as they are able to handle the higher bandwidths required. The umbilical is typically terminated in an umbilical termination assembly (UTA) whereby power and communications are distributed to the multiplicity of well trees typical of a subsea well complex, for example either directly or via one or more subsea distribution units. Communication from the UTA can be via fiber optics and/or copper in dependence on a combination of the bandwidth requirements and distances of the individual well trees from the UTA. Termination of the optical fibers from the umbilical is effected by fiber optic connectors, typically as many as at least six being required, with linking of the UTA outputs to the well trees requiring further connectors. The problem is that optical fiber connectors suitable for the high water pressure environment of subsea wells are expensive and typically do not have the confidence of well operators as much as well-established electrical connectors. This invention removes the need for fiber optic connectors.

BRIEF DESCRIPTION OF THE INVENTION

According to the present invention from one aspect, there is provided a communication connection in a subsea well for converting an optical signal from an optic fiber to an electrical signal, comprising a small form factor pluggable device.

According to the present invention from another aspect there is provided a method of providing a communication connection in a subsea well for converting an optical signal from an optical fiber to an electrical signal, comprising using a small form factor pluggable device to convert the optical signal to an electrical signal.

The connection could be between said optical fiber and a subsea electronics module at a well tree or at an underwater termination assembly or at a subsea distribution unit for example.

Said fiber is typically in an umbilical.

There could be a further small form factor pluggable device coupled with the first small form factor pluggable device for converting said electrical signal to an optical signal.

Each small form factor pluggable device could be received in an electrical connector. In this case, the connector could comprise first and second mated parts, each having a respective shell portion, each small form factor pluggable device being received in a respective one of the shells.

Where the connection is between said optical fiber and a subsea electronics module, power for each small form factor pluggable device could be provided from the subsea electronics module.

Alternatively, power for each small form factor pluggable device could be provided by electrical power supplied from a surface facility or by optical energy from a further optical fiber or by a rechargeable battery.

DETAILED DESCRIPTION OF THE INVENTION

Figure 1:
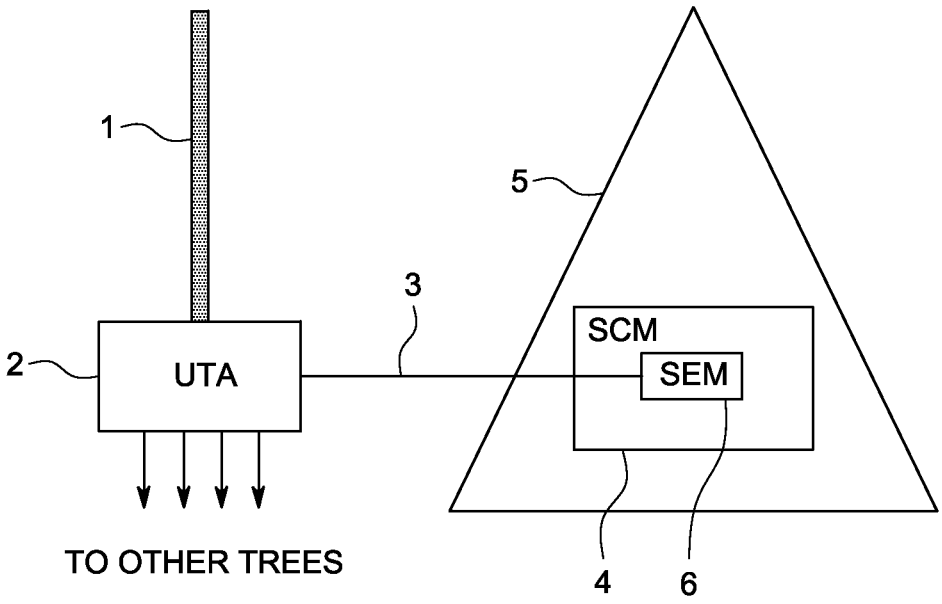
FIG. 1 shows diagrammatically the termination of an umbilical at a UTA, together with a well tree coupled with the UTA.

FIG. 1 shows a typical arrangement of the termination of an umbilical 1 from a surface facility such as a surface platform or surface vessel at UTA 2, the output 3 of which feeds hydraulic power to a subsea control module (SCM) 4 mounted on a well tree 5 and feeds electrical power and communication to a subsea electronic module (SEM) 6 housed in the SCM 4. The UTA 2 also feeds hydraulic and electrical power and communications to other trees in a well complex.

In FIGS. 2*a*-2*c* and 3*a*-3*c*, reference numeral 7 denotes an optical fiber in an umbilical from a UTA, reference numeral 8 designates a small form factor pluggable device (SFP) at which the fiber 7 terminates and reference numerals 10 and 11 designate two mated together parts of a copper connector having end shells 12 and 16 respectively, the SFP 8 being mounted in and molded into the end shell 12 of the connector part 10.

Figure 2A:
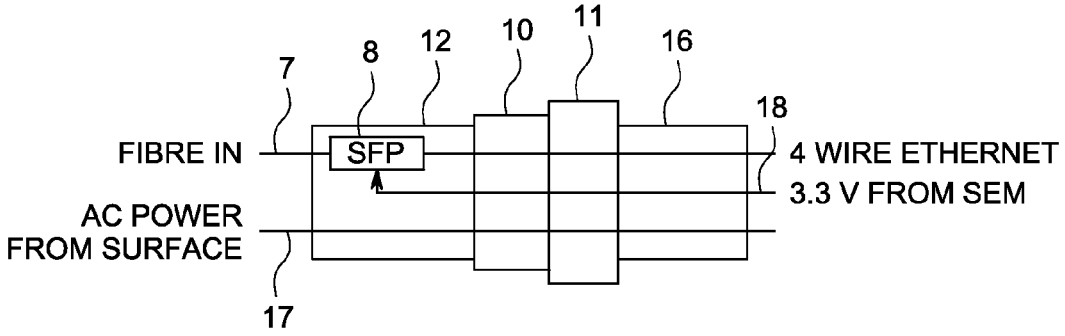
FIGS. 2*a*-2*c* show a first set of embodiments of the invention.
Figure 2B:
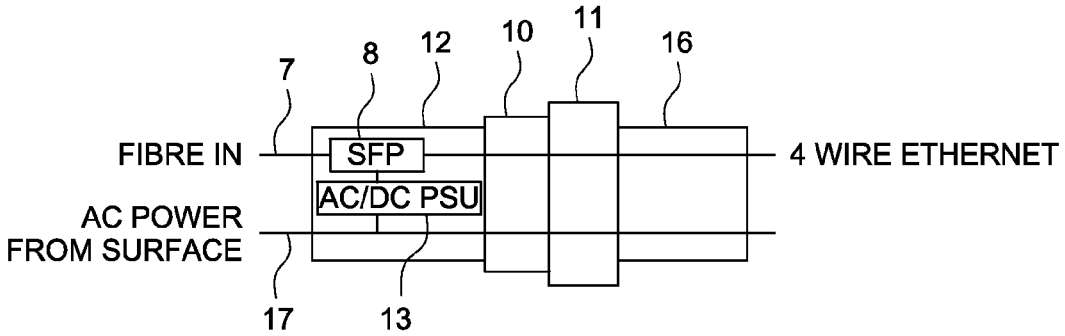
Figure 2C:
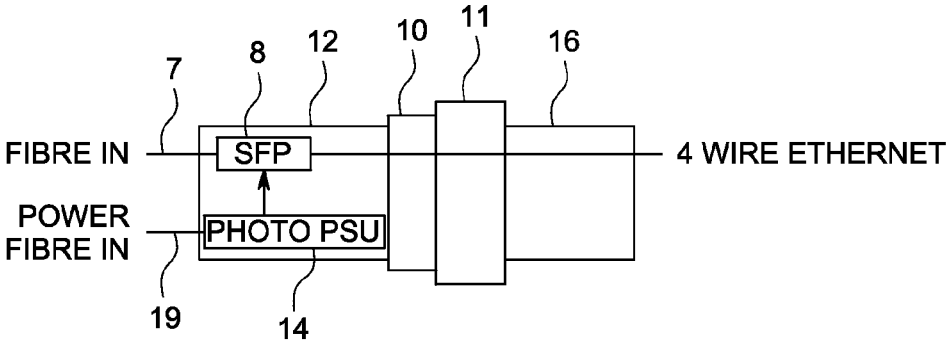

FIG. 2*a* shows an arrangement according to the invention where the required communication interface to the SEM is copper, such as 4-wire Ethernet, reference numeral 17 designating a line carrying AC power from the umbilical from the surface facility. SFPs suitable for the invention are available off the shelf Electric power is required for the SFP 8, typically at 3.3 volts. This can be provided from the DC power supplies already available in the SEM via a line 18. Alternatively, since the power requirements of the SFP 8 are small, an alternative power source, as shown in FIG. 2*b*, is practical in which a small AC to DC power supply unit 13, such as a switching or capacitor fed power supply, deriving power from the AC power on line 17 is also mounted in the end shell 12. This arrangement saves two connections through the connector 10/11, which can result in significant cost reduction. A further alternative way of providing electric power to the SFP 8 (particularly if there are spare optical fibers in the umbilical from the UTA and as illustrated in FIG. 2*c*) is to transmit light down a fiber 19 and utilize a photovoltaic cell to convert the light to electrical power to supply the SFP, i.e. a photovoltaic power supply unit 14, which can also be molded in the end shell 12 of the connector 10/11. The light typically would be provided via the umbilical from the surface facility to the UTA.

Figure 3A:
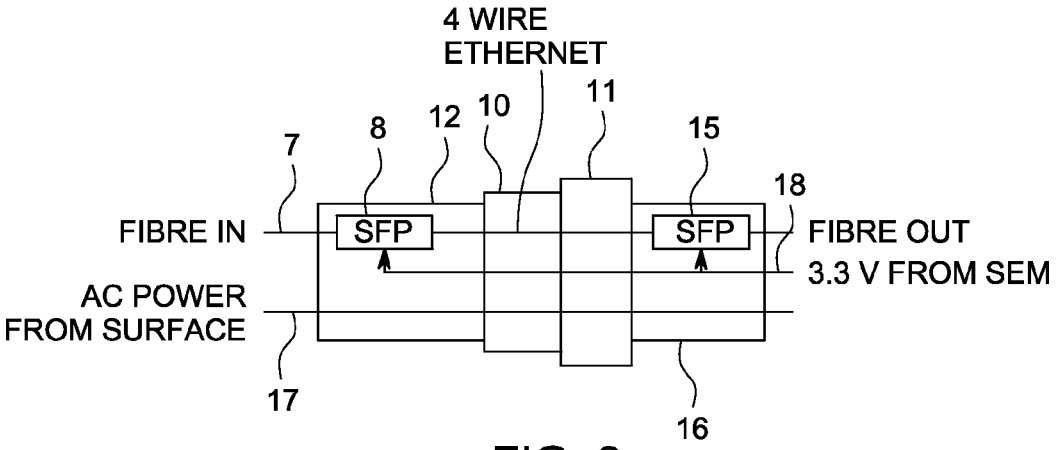
FIGS. 3*a*-3*c* show a second set of embodiments of the invention.
Figure 3B:
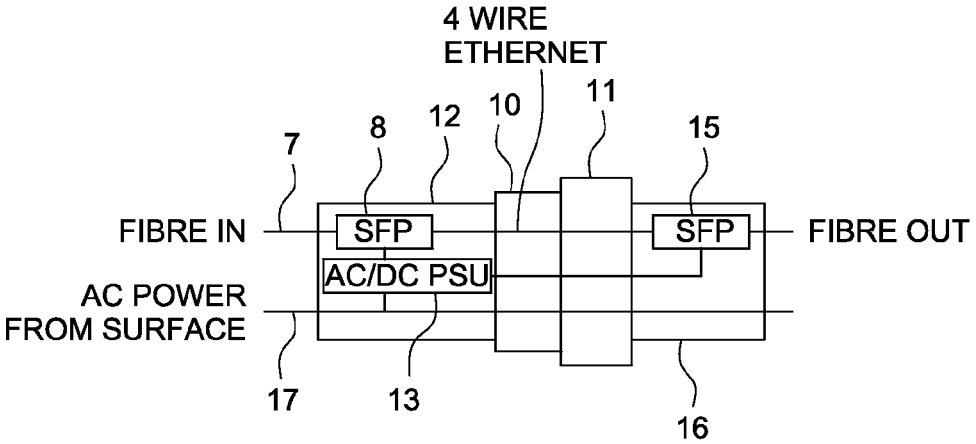
Figure 3C:
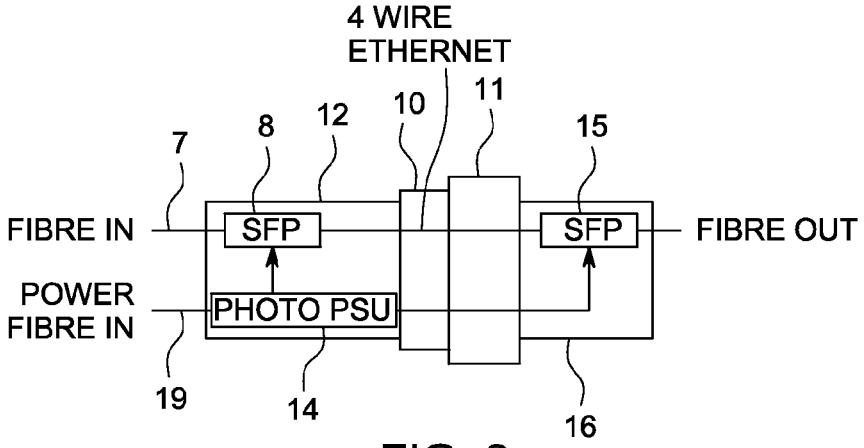

FIGS. 3*a*-3*c* show modifications of the embodiments of FIGS. 2*a*-2*c* respectively where the required communication interface to the SEM is optical fiber. In FIG. 3*a*, an SFP 15 is also mounted in and molded in the end shell 16 of connector part 11 of the mated copper connector 10/11. The SFP 8 converts the fiber optic output to an electrical interface, such as 4-wire Ethernet, which feeds through the copper connector 10/11 to the SFP 15 which converts the electrical interface back to a fiber optic one. Thus, an electrical connector can be used to achieve the interface instead of a much more expensive optical fiber connector. The short length of copper in the connector 10/11 allows data rates of up to 100 Mbits/second, which is adequate for most subsea well applications and typically matches the fiber optic achievable bandwidth. Electrical power for the SFPs 8 and 15 is provided (as in FIG. 2*a*) from existing power supplies in the SEM. FIG. 3*b* shows an arrangement in which electric power is supplied to the SFPs 8 and 15 by a small power supply unit as in FIG. 2*b* and FIG. 3*c* shows the power supply derived from a photovoltaic cell 14 energized by light via a spare optical fiber as in FIG. 2*c*.

The present invention may be applied not just to an optical fiber connection at a well tree, but also to an optical fiber connection at a UTA (e.g. from an umbilical from a surface facility or out of the UTA) and/or into or out of a subsea distribution unit. Also, the invention is not restricted to the use of 4-wire Ethernet—it may be applied, for example, to any form of serial communications. A further alternative to the forms of power supply for each SFP is to use a rechargeable battery, for example a battery rechargeable using light from an optical fiber.

Expensive fiber optic connectors are eliminated and replaced by much cheaper electrical connectors.

Many modern wells and their SEMs employ Ethernet interfaces. This invention provides a neat and low cost direct conversion from the fiber optic output of the umbilical to the Ethernet communication system.

What is claimed is:

1. A communication connection in a subsea well for an optical fiber, the communication connection comprising:

an electrical connector comprising first and second mating parts, each of the first and the second mating parts is having a respective shell portion;

a first small form factor pluggable device received in the shell portion of the first mating part for converting an optical signal of the optical fiber into an electrical signal; and a second small form factor pluggable device received in the shell portion of the second mating part for converting the electrical signal back to an optical signal;

wherein a power for both the first and the second small form factor pluggable devices is provided by an optical energy from a further optical fiber in a communication with a photovoltaic cell, wherein the photovoltaic cell is to convert the optical energy into the power for both the first and the second small form factor pluggable devices, and wherein the photovoltaic cell is molded in an end portion of the electrical connector.

2. The communication connection of claim 1, wherein the communication connection is between the optical fiber and a subsea electronics module at a well tree.

3. The communication connection of claim 2, wherein:

the power for both the first and the second small form factor pluggable devices is provided from the subsea electronics module.

4. The communication connection of claim 1, wherein the optical fiber is in an umbilical.

5. The communication connection of claim 1, wherein the first and the second small form factor pluggable devices are received in the electrical connector.

6. The communication connection of claim 1, wherein the power for both the first and the second small form factor pluggable devices is provided by a rechargeable battery.

7. The communication connection of claim 1, wherein the communication connection is between the optical fiber and a subsea electronics module is at an underwater termination assembly.

8. The communication connection of claim 1, wherein the communication connection is between the optical fiber and a subsea electronics module is at a subsea distribution unit.

9. A method of providing a communication connection in a subsea well, the method comprising:

providing first and second mated parts which are coupled to each other, each of the first and second mated parts is having a respective shell portion;

using a first small form factor pluggable device to convert an optical signal to an electrical signal;

disposing the first small form factor pluggable device to be received in the shell portion of the first mated part for converting the optical signal of an optical fiber into the electrical signal; and disposing a second small form factor pluggable device to be received in the shell portion of the second mated part for converting the electrical signal back to an optical signal, wherein the first and the second small form factor pluggable devices are received in an electrical connector;

powering both the first and the second small form factor pluggable devices by an optical energy from a further optical fiber in a communication with a photovoltaic cell, wherein the photovoltaic cell is to convert the optical energy into a power for the first and the second small form factor pluggable devices, and wherein the photovoltaic cell is molded in an end portion of the electrical connector.

10. The method of claim 9, wherein the communication connection is between the optical fiber and a subsea electronics module is at a well tree.

11. The method of claim 10, wherein said powering both the first and second small form factor pluggable devices are provided from the subsea electronics module.

12. The method of claim 9, wherein the optical fiber is in an umbilical.

13. The method of claim 9, wherein said powering both the first and second small form factor pluggable devices are provided by a rechargeable battery.

14. The method of claim 9, wherein the communication connection is between the optical fiber and a subsea electronics module is at an underwater termination assembly.

15. The method of claim 9, wherein the communication connection is between the optical fiber and a subsea electronics module is at a subsea distribution unit.

* * * * *